US008926286B2

(12) United States Patent
Takeda

(10) Patent No.: US 8,926,286 B2
(45) Date of Patent: Jan. 6, 2015

(54) PROPELLER FAN, MOLDING DIE, AND FLUID FEEDER

(75) Inventor: Yasukata Takeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 316 days.

(21) Appl. No.: 13/395,194

(22) PCT Filed: Sep. 7, 2010

(86) PCT No.: PCT/JP2010/065301

§ 371 (c)(1),
(2), (4) Date: Mar. 9, 2012

(87) PCT Pub. No.: WO2011/030748

PCT Pub. Date: Mar. 17, 2011

(65) Prior Publication Data

US 2012/0171042 A1 Jul. 5, 2012

(30) Foreign Application Priority Data

Sep. 11, 2009 (JP) ..... 2009-210295

(51) Int. Cl.
*F04D 29/38* (2006.01)

(52) U.S. Cl.
CPC ..... *F04D 29/384* (2013.01)
USPC ..... 416/223 R

(58) Field of Classification Search
USPC ..... 29/889.3
See application file for complete search history.

(56) References Cited

U.S. PATENT DOCUMENTS 958,599 A * 5/1910 Cooksey ..... 416/238
1,413,296 A * 4/1922 Spreekmeester ..... 416/129
3,951,611 A * 4/1976 Morrill ..... 428/587
4,347,038 A * 8/1982 Hayashi et al. ..... 416/132 A
4,840,541 A 6/1989 Sakane et al.
5,409,656 A * 4/1995 Naruse et al. ..... 264/275
2008/0232983 A1 9/2008 Yamazaki et al.

FOREIGN PATENT DOCUMENTS

EP 1 238 185 B1 10/2005
JP 63-83496 U 6/1988
JP 64-397 A 1/1989
JP 3-88999 A 4/1991

(Continued)

*Primary Examiner* — Nathaniel Wiehe
*Assistant Examiner* — Woody A Lee, Jr.
(74) *Attorney, Agent, or Firm* — Birch, Stewart, Kolasch & Birch, LLP

(57) ABSTRACT

A propeller fan with two blades includes a blade and a blade, and a connection portion connecting the blades together. Each blade has a peripheral edge portion extending in an arc having a diameter D with a center axis as a center thereof, a front edge portion arranged on a forward side in a rotational direction, a rear edge portion arranged on an opposite side in the rotational direction, and a leading blade edge portion connecting the front edge portion and the peripheral edge portion. A plane which includes each intersection between the rear edge portion and the peripheral edge portion and is perpendicular to the center axis is defined as γ. When the propeller fan is viewed in a direction parallel to a plane including the leading blade edge portions and the center axis, a distance H between plane γ and a connected portion between the front edge portion of the blade and the rear edge portion of the blade, on a line of the center axis, satisfies $0.028 \leq H/D \leq 0.056$. With such a structure, a propeller fan, a molding die, and a fluid feeder which make a significant contribution in terms of energy-saving properties and resource-saving design can be provided.

10 Claims, 15 Drawing Sheets

(56) References Cited

FOREIGN PATENT DOCUMENTS

| | | | |
|---|---|---|---|
| JP | 6-67893 | U | 9/1994 |
| JP | 2000-314399 | A | 11/2000 |
| JP | 2004-132211 | A | 4/2004 |
| JP | 2007-218103 | A | 8/2007 |
| JP | 2008-240526 | A | 10/2008 |
| JP | 2010-101223 | A | 5/2010 |
| JP | 2010-101227 | A | 5/2010 |

* cited by examiner

PROPELLER FAN, MOLDING DIE, AND FLUID FEEDER

TECHNICAL FIELD

The present invention generally relates to a propeller fan, a molding die, and a fluid feeder, and more specifically to a propeller fan for an air blower, a molding die for molding such a propeller fan from resin, and a fluid feeder provided with such a propeller fan such as an outdoor unit of an air conditioner, an air purifier, a humidifier, a dehumidifier, a fan heater, a cooling device, and a ventilating device.

BACKGROUND ART

In connection with conventional propeller fans, for example, Japanese Patent Laying-Open No. 3-88999 has disclosed an axial fan aimed at increasing lift of propeller blades and also improving strength thereof by supplying, in a separated fashion, positive and negative pressures to positive and negative pressure surfaces of each propeller blade, respectively (PTL 1). The axial fan disclosed in PTL 1 has a plurality of propeller blades that are formed on the outer periphery of a hub and extend radially outward from an axis of the hub.

Further, Japanese Patent Laying-Open No. 2000-314399 has disclosed a propeller fan aimed at eliminating necessity of post treatment on a boss portion at a rotation axis aperture portion, and improving gate processing (PTL 2). The propeller fan disclosed in PTL 2 has a cylindrical or conical hub portion, and blade portions formed integrally with the hub portion.

Furthermore, various propeller fans have been disclosed in Japanese Patent Laying-Open No. 64-397 (PTL 3), Japanese Patent Laying-Open No. 2008-240526 (PTL 4), and Japanese Patent Laying-Open No. 2004-132211 (PTL 5).

CITATION LIST

Patent Literature

PTL 1: Japanese Patent Laying-Open No. 3-88999
PTL 2: Japanese Patent Laying-Open No. 2000-314399
PTL 3: Japanese Patent Laying-Open No. 64-397
PTL 4: Japanese Patent Laying-Open No. 2008-240526
PTL 5: Japanese Patent Laying-Open No. 2004-132211

SUMMARY OF INVENTION

Technical Problem

Conventionally, propeller fans have been used in air blowers and cooling machines. For example, an outdoor unit of an air conditioner is provided with a propeller fan for blowing air to a heat exchanger. The propeller fan has such characteristics that air blowing capacity near a center portion of the fan where a peripheral speed is low is smaller than that on a radially outer side of the fan. Due to such characteristics, when a resistance object causing a large pressure loss such as a heat exchanger is installed in an air blowing passage, air is blown forward on the radially outer side of the fan, but a reverse flow occurs near the center portion of the fan. This results in a problem that pressure-flow rate characteristics (i.e., characteristics relating to a pressure and a flow rate) of the fan deteriorate in a high static-pressure range.

Also, as disclosed in PTL 1 and PTL 2 described above, propeller fans having a structure that a large boss hub portion is provided at the center of rotation, and a plurality of blades extend from the outer periphery of the boss hub portion have been known. In such propeller fans, since the large boss hub portion closes a reverse flow region near a center portion of the fan, it is possible to prevent a reverse flow and to suppress deterioration of pressure-flow rate characteristics of the fan in a high static-pressure range. In addition, the blade usually has an attack angle. Therefore, base portions of the plurality of blades exhibit twisted positional relationship if the base portions of the blades extend as they are. However, the provision of the large boss hub portion can facilitate integral formation of the plurality of blades that perform air blowing.

However, the above propeller fan provided with the large boss hub portion newly suffers from a plurality of problems described below.

A first problem is as follows. Although it is possible to suppress the deterioration of the pressure-flow rate characteristics in the high static-pressure range to a certain extent, the rotation center portion cannot be sufficiently utilized in a range of a low pressure and a high air flow rate, resulting in a problem that air blowing efficiency is lowered. A second problem is as follows. The provision of the large boss hub portion increases a mass of the propeller fan itself, and therefore increases a load on a drive motor, resulting in a problem of increased power consumption. A third problem is an increase in material cost and therefore an increase in manufacturing cost. These three problems result in remarkable disadvantages in terms of energy-saving properties and resource-saving design, considering recent global environment.

Accordingly, an object of the present invention is to solve the above problems, and to provide a propeller fan, a molding die, and a fluid feeder which make a significant contribution in terms of energy-saving properties and resource-saving design.

Solution to Problem

A propeller fan according to one aspect of the present invention is a propeller fan with two blades. The propeller fan includes a first blade and a second blade constituting the two blades, and a connection portion connecting the first blade and the second blade together. The first blade and the second blade are provided to be circumferentially separated from each other for performing air blowing according to rotation around an imaginary center axis. When the propeller fan is viewed in an axial direction of the center axis and a smallest imaginary circle is drawn to circumferentially separate the first blade and the second blade from each other, the connection portion is arranged inside the imaginary circle. Each of the first blade and the second blade has a peripheral edge portion extending in an arc having a diameter D with the center axis as a center thereof, a front edge portion arranged on a forward side in a rotational direction, a rear edge portion arranged on an opposite side in the rotational direction and continuing to the peripheral edge portion, and a leading blade edge portion connecting the front edge portion and the peripheral edge portion and protruding toward the rotational direction. The front edge portion of the first blade and the rear edge portion of the second blade are connected together via the connection portion. A plane which includes each intersection between the rear edge portion and the peripheral edge portion in each of the first blade and the second blade and is perpendicular to the center axis is defined as γ. When the propeller fan is viewed in a direction parallel to a plane including the leading blade edge portions of the first blade and the second blade and the center axis, a distance H between plane γ and a connected portion between the front edge portion of the first blade and the rear edge portion of the second blade, on a line of the center axis, satisfies $0.028 \leq H/D \leq 0.056$.

According to the propeller fan configured as described above, by setting distance H between plane γ and the connected portion between the front edge portion of the first blade and the rear edge portion of the second blade to be not less than 0.028 times diameter D of the peripheral edge portions of the blades, the blades are inclined with respect to the plane perpendicular to the center axis to be more warped toward the axial direction of the center axis, at the connected portion between the front edge portion of the first blade and the rear edge portion of the second blade. Thereby, air easily flows onto a positive pressure surface (blade surface on an air outlet side) near the rotation center of the blades, and air blowing capacity of the propeller fan can be efficiently enhanced. Further, by setting distance H to be not more than 0.056 times diameter D of the peripheral edge portions of the blades, the blades are prevented from being inclined too much at the connected portion between the front edge portion of the first blade and the rear edge portion of the second blade. This prevents occurrence of separation of an air flow on a negative pressure surface (blade surface on an air intake side) opposite to the positive pressure surface, and subsequent reduction in air blowing capacity of the propeller fan. As a result, a propeller fan with two blades which makes a significant contribution in terms of energy-saving properties and resource-saving design can be implemented.

Preferably, the connection portion has a blade surface-like surface for performing air blowing according to rotation in a region which extends between the first blade and the second blade and connects a base portion of the first blade and a base portion of the second blade.

According to the propeller fan configured as described above, by forming the blade surface-like surface for performing air blowing according to rotation in the connection portion, air can be blown forward even near the rotation center of the blades, and air blowing capacity can be improved.

A propeller fan according to another aspect of the present invention is a propeller fan with three blades. The propeller fan includes a first blade, a second blade, and a third blade constituting the three blades, and a connection portion connecting the first blade, the second blade, and the third blade together. The first blade, the second blade, and the third blade are provided to be circumferentially separated from each other for performing air blowing according to rotation around an imaginary center axis. When the propeller fan is viewed in an axial direction of the center axis and a smallest imaginary circle is drawn to circumferentially separate the first blade, the second blade, and the third blade from each other, the connection portion is arranged inside the imaginary circle. Each of the first blade, the second blade, and the third blade has a peripheral edge portion extending in an arc having a diameter D with the center axis as a center thereof, a front edge portion arranged on a forward side in a rotational direction, a rear edge portion arranged on an opposite side in the rotational direction and continuing to the peripheral edge portion, and a leading blade edge portion connecting the front edge portion and the peripheral edge portion and protruding toward the rotational direction. The second blade is arranged to be adjacent to the first blade on the forward side in the rotational direction, and the third blade is arranged to be adjacent to the second blade on the forward side in the rotational direction. The front edge portion of the first blade and the rear edge portion of the second blade are connected together via the connection portion. A plane which includes each intersection between the rear edge portion and the peripheral edge portion in each of the first blade, the second blade, and the third blade and is perpendicular to the center axis is defined as γ. When the propeller fan is viewed in a direction perpendicular to a plane including the leading blade edge portion of the third blade and the center axis, a distance H between plane γ and a connected portion between the front edge portion of the first blade and the rear edge portion of the second blade, on a line of the center axis, satisfies $0.028 \leq H/D \leq 0.056$.

According to the propeller fan configured as described above, by setting distance H between plane γ and the connected portion between the front edge portion of the first blade and the rear edge portion of the second blade to be not less than 0.028 times diameter D of the peripheral edge portions of the blades, the blades are inclined with respect to the plane perpendicular to the center axis to be more warped toward the axial direction of the center axis, at the connected portion between the front edge portion of the first blade and the rear edge portion of the second blade. Thereby, air easily flows onto a positive pressure surface (blade surface on an air outlet side) near the rotation center of the blades, and air blowing capacity of the propeller fan can be efficiently enhanced. Further, by setting distance H to be not more than 0.056 times diameter D of the peripheral edge portions of the blades, the blades are prevented from being inclined too much at the connected portion between the front edge portion of the first blade and the rear edge portion of the second blade. This prevents occurrence of separation of an air flow on a negative pressure surface (blade surface on an air intake side) opposite to the positive pressure surface, and subsequent reduction in air blowing capacity of the propeller fan. As a result, a propeller fan with three blades which makes a significant contribution in terms of energy-saving properties and resource-saving design can be implemented.

Preferably, the connection portion has a blade surface-like surface for performing air blowing according to rotation in a region which extends between adjacent blades among the first blade, the second blade, and the third blade and connects base portions of the adjacent blades.

According to the propeller fan configured as described above, by forming the blade surface-like surface for performing air blowing according to rotation in the connection portion, air can be blown forward even near the rotation center of the blades, and air blowing capacity can be improved.

Preferably, the imaginary circle has a diameter d satisfying $0.14 \leq d/D$. According to the propeller fan configured as described above, the connection portion is prevented from having a size which is too small relative to an outer peripheral dimension of the blades and results in an insufficient strength of the propeller fan.

Preferably, the propeller fan according to any of the above descriptions is molded from resin. According to the propeller fan configured as described above, a propeller fan having a light weight and high rigidity can be implemented.

A molding die according to the present invention is used for molding the propeller fan according to any of the above descriptions from resin. According to the molding die configured as described above, a propeller fan made of resin and having a light weight and high rigidity can be manufactured.

A fluid feeder according to the present invention includes the propeller fan according to any of the above descriptions. According to the fluid feeder configured as described above, a fluid feeder which makes a significant contribution in terms of energy-saving properties and resource-saving design can be implemented by including the propeller fan according to the present invention.

Advantageous Effects of Invention

As described above, according to the present invention, a propeller fan, a molding die, and a fluid feeder which make a significant contribution in terms of energy-saving properties and resource-saving design can be provided.

DESCRIPTION OF EMBODIMENTS

Figure 1:
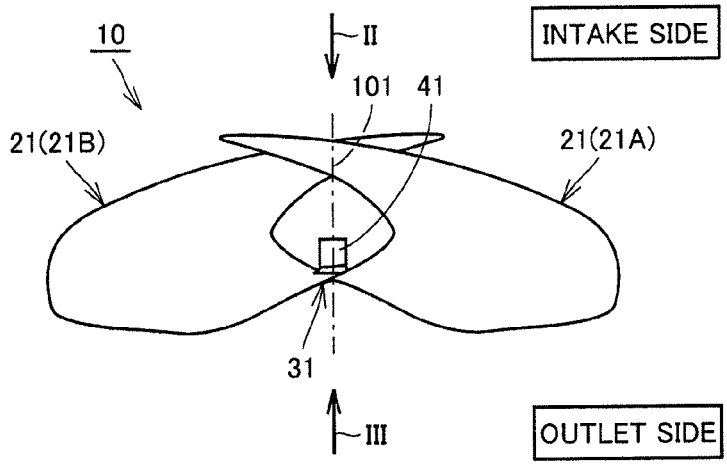
FIG. 1 is a side view showing a propeller fan with two blades according to a first embodiment of the present invention.

Embodiments of the present invention will now be described with reference to the drawings. In the drawings referred to below, identical or corresponding members will be designated by the same reference numbers.

First Embodiment

Description of Structure of Propeller Fan with Two Blades

Figure 2:
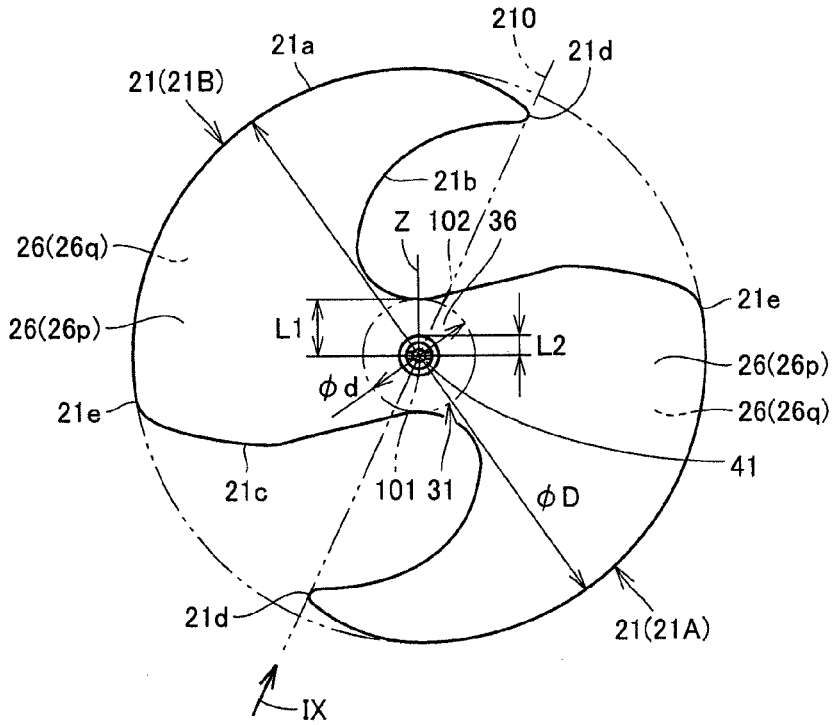
FIG. 2 is a plan view showing the propeller fan viewed in a direction indicated by an arrow II in FIG. 1 (i.e., from an intake side).
Figure 3:
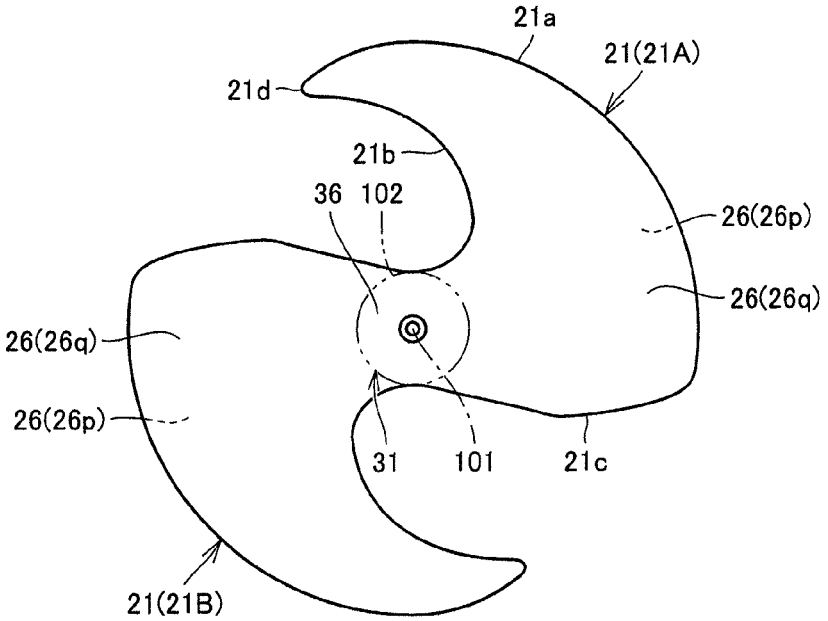
FIG. 3 is a plan view showing the propeller fan viewed in a direction indicated by an arrow III in FIG. 1 (i.e., from an outlet side).
Figure 4:
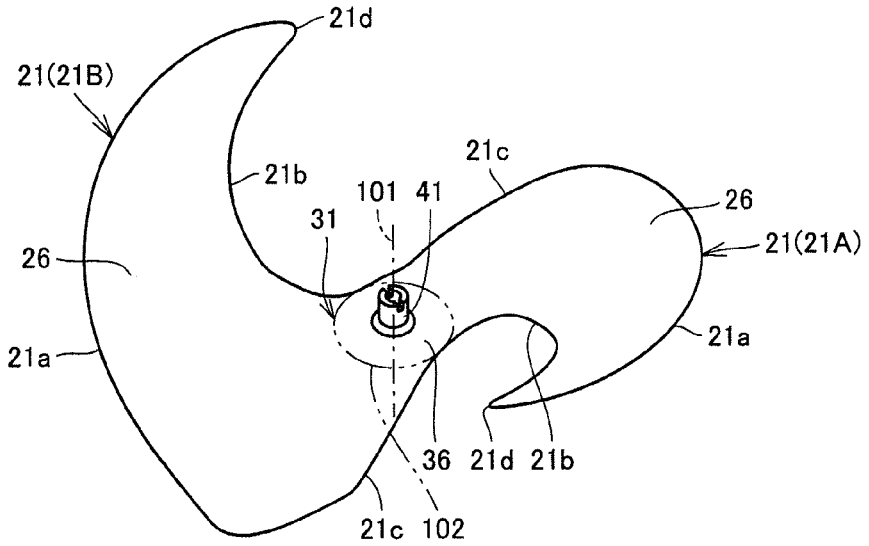
FIG. 4 is a perspective view of the propeller fan in FIG. 1 viewed from the intake side.

FIG. 1 is a side view showing a propeller fan with two blades according to a first embodiment of the present invention. FIG. 2 is a plan view showing the propeller fan viewed in a direction indicated by an arrow II in FIG. 1 (i.e., from an intake side). FIG. 3 is a plan view showing the propeller fan viewed in a direction indicated by an arrow III in FIG. 1 (i.e., from an outlet side). FIG. 4 is a perspective view of the propeller fan in FIG. 1 viewed from the intake side.

Referring to FIGS. 1 to 4, a propeller fan 10 according to the present embodiment is a propeller fan with two blades, and is integrally molded from synchronous resin such as glass-fiber-filled AS (Acrylonitrile-Styrene) or the like.

Propeller fan 10 has blades 21A and 21B (which may be collectively referred to as "blades 21" hereinafter), and a connection portion 31 connecting (coupling) blades 21A and 21B with each other. Propeller fan 10 rotates around a center axis 101 that is an imaginary axis, and blows air from the intake side to the outlet side in FIG. 1.

As shown in FIG. 2, when propeller fan 10 is viewed in an axial direction of center axis 101 and a smallest imaginary circle 102 is drawn to separate blades 21A and 21B from each other in a circumferential direction of center axis 101, connection portion 31 is defined inside imaginary circle 102, and blades 21A and 21B are defined outside imaginary circle 102.

Blades 21A and 21B are equally spaced from each other in the circumferential direction of a rotation axis of propeller fan 10, i.e., center axis 101. Blades 21A and 21B are formed to have an identical shape, and formed such that their shapes match each other when one of them is rotated around center axis 101 toward the other.

Blade 21 has a front edge portion 21*b* located on a forward side in a rotational direction of propeller fan 10, a rear edge portion 21*c* located on the opposite side in the rotational direction, and a peripheral edge portion 21*a* located on the radially outermost side with respect to center axis 101. Peripheral edge portion 21*a* is formed to extend in an arc having a diameter D with center axis 101 as its center. Peripheral edge portion 21*a* is formed such that one end thereof extending in an arc continues to rear edge portion 21*c*.

Blade 21 also has a leading blade edge portion 21*d*. Leading blade edge portion 21*d* is formed to connect between peripheral edge portion 21*a* and front edge portion 21*b*. Leading blade edge portion 21*d* has a crescent- or scythe-like sharp shape. Peripheral edge portion 21*a* is formed such that the other end thereof extending in an arc continues to front edge portion 21*b* through leading blade edge portion 21*d*. Leading blade edge portion 21*d* is provided in blade 21 in which that leading blade edge portion 21*d* is formed, to be located on the most leading side in the rotational direction of propeller fan 10.

When propeller fan 10 is viewed in the axial direction of center axis 101, the outer shape of blade 21 is composed of front edge portion 21*b*, leading blade edge portion 21*d*, peripheral edge portion 21*a*, and rear edge portion 21*c*.

Blade 21 has a blade surface 26 that performs air blowing according to rotation of propeller fan 10 (i.e., blows air from the intake side to the outlet side).

Blade surface 26 is formed on each of the sides facing the intake side and the outlet side. Blade surface 26 is formed in a region surrounded by front edge portion 21*b*, leading blade edge portion 21*d*, peripheral edge portion 21*a*, and rear edge portion 21*c*. Blade surface 26 is formed throughout the region surrounded by front edge portion 21*b*, leading blade edge portion 21*d*, peripheral edge portion 21*a*, and rear edge portion 21*c*. Each of blade surfaces 26 of blades 21A and 21B is formed of a curved surface that inclines from the intake side toward the outlet side in the circumferential direction from front edge portion 21*b* toward rear edge portion 21*c*.

Blade surface 26 includes a positive pressure surface 26*q*, and a negative pressure surface 26*p* arranged on the back side of positive pressure surface 26*q*. Positive pressure surface 26*q* is formed on a side of blade surface 26 facing the outlet side, and negative pressure surface 26*p* is formed on a side of blade surface 26 facing the intake side. During rotation of propeller fan 10, an air flow is generated on blade surface 26, resulting in a pressure distribution in which pressure is relatively high on positive pressure surface 26*q* and is relatively low on negative pressure surface 26*p*.

Base portions of blades 21A and 21B arranged on the outer periphery of imaginary circle 102 are coupled together by connection portion 31 arranged around center axis 101.

Connection portion 31 has blade surfaces 36 on the sides facing the intake side and the outlet side, respectively, and is formed in a blade-like shape. Blade surface 36 is formed continuously from each of blade surfaces 26 of blades 21A and 21B. Blade surfaces 26 of blades 21A and 21B are formed continuously to each other through blade surface 36. In the present embodiment, front edge portion 21*b* of blade 21A is opposed to rear edge portion 21*c* of blade 21B, and front edge portion 21*b* of blade 21B is opposed to rear edge portion 21*c* of blade 21A, in a direction connecting blades 21A and 21B. Therefore, the direction of inclination of blade surface 36 on the blade 21A side and the direction of inclination of blade surface 36 on the blade 21B side exhibit such positional relationship that these directions are twisted with respect to each other with center axis 101 located therebetween. The inclination of the blade surfaces decreases as the position moves from blade surface 26 of each of blades 21A and 21B to blade surface 36 of connection portion 31, and blade surface 36 on the blade 21A side is eventually smoothly connected to blade surface 36 on the blade 21B side on a line passing through center axis 101. That is, blades 21A and 21B as well as connection portion 31 form blade surfaces 26 and blade surface 36, respectively, which are formed to be in contact with each other integrally and continuously.

In propeller fan 10 according to the present embodiment, a region coupling the base portions of blades 21A and 21B together in connection portion 31 is formed to have a shape of a blade surface that performs air blowing according to rotation.

As most clearly shown in FIG. 4, front edge portion 21*b* of blade 21A and rear edge portion 21*c* of blade 21B are connected together via connection portion 31, and front edge portion 21*b* of blade 21B and rear edge portion 21*c* of blade 21A are connected together via connection portion 31. Imaginary circle 102 is drawn to be in contact with a connected portion between front edge portion 21*b* of blade 21A and rear edge portion 21*c* of blade 21B, and to be in contact with a connected portion between front edge portion 21*b* of blade 21B and rear edge portion 21*c* of blade 21A.

Connection portion 31 is formed to extend from the intake side to the outlet side in an air flow feeding direction as the position moves from the base portion of blade 21A on the front edge portion 21*b* side toward the base portion of blade 21B on the rear edge portion 21*c* side, and to extend from the intake side to the outlet side in the air flow feeding direction as the position moves from the base portion of blade 21B on the front edge portion 21*b* side toward the base portion of blade 21A on the rear edge portion 21*c* side. Connection portion 31 is configured to have a function of feeding air from the intake side to the outlet side in the air flow feeding direction of propeller fan 10.

Blades 21A and 21B as well as connection portion 31 have thin shapes, respectively, and are integrally molded. Specifically, in propeller fan 10 according to the present embodiment, one-piece two blades extending radially outward from center axis 101 as its center are integrally molded with blades 21A and 21B as well as connection portion 31. Propeller fan 10 is integrally molded, including blades 21A and 21B as well as connection portion 31 coupling the base portions of blades 21A and 21B together.

Propeller fan 10 has a boss hub portion 41 as a rotation axis portion. Boss hub portion 41 is a portion connecting propeller fan 10 to an output shaft of a motor (not shown) as a drive source thereof. Boss hub portion 41 has a cylindrical shape, and is connected to connection portion 31 at a position overlapping center axis 101. Boss hub portion 41 is formed to extend in the axial direction of center axis 101 from blade surface 36 on the intake side. In propeller fan 10 according to the present embodiment, boss hub portion 41, which is a member for rotationally driving blades 21A and 21B to rotate around the region coupling the base portions of blades 21A and 21B together, is provided integrally with propeller fan 10.

The shape of boss hub portion 41 is not limited to a cylindrical shape, and can be appropriately changed according to the connection structure for the output shaft of the motor. Boss hub portion 41 may be formed to extend from blade surface 36 on the outlet side, or may be formed to extend from blade surfaces 36 on the intake and outlet sides.

Connection portion 31 is formed to extend radially outward from an outer peripheral surface of boss hub portion 41. In other words, connection portion 31 is formed such that, when propeller fan 10 is viewed in the axial direction of center axis 101, a minimum distance L1 from center axis 101 to the outer edge of connection portion 31 on an imaginary line Z perpendicularly intersecting with center axis 101 is larger than a distance L2 from center axis 101 to the outer edge of boss hub portion 41 on imaginary line Z (see FIG. 2).

Figure 5:
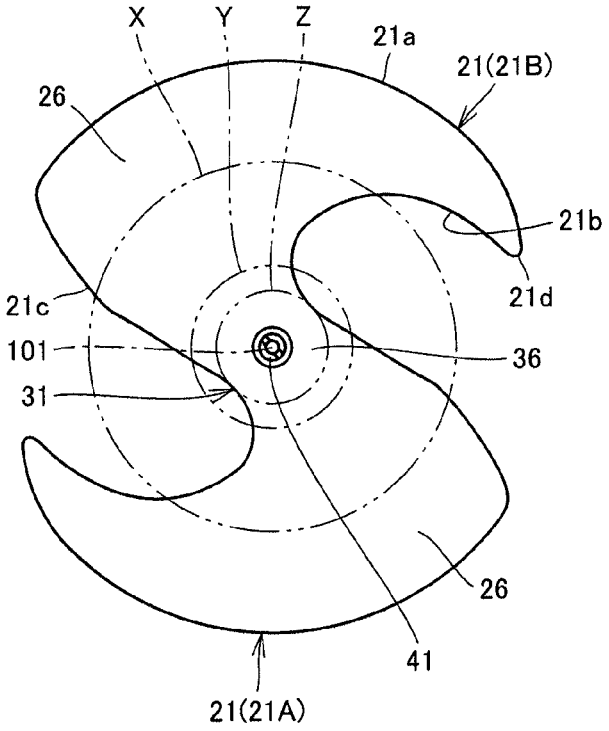
FIG. 5 is a plan view showing an example of the propeller fan in FIG. 1.
Figure 6:
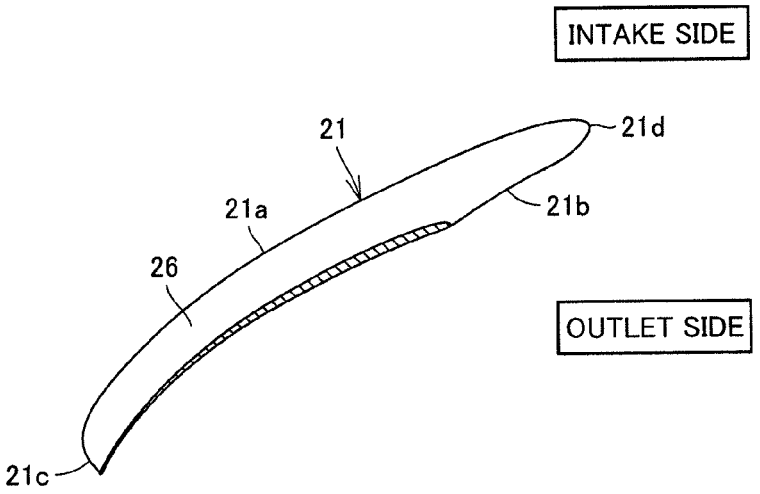
FIG. 6 is a perspective view showing a sectional shape of the propeller fan in FIG. 5 taken at a position indicated by a two-dot chain line X.
Figure 7:
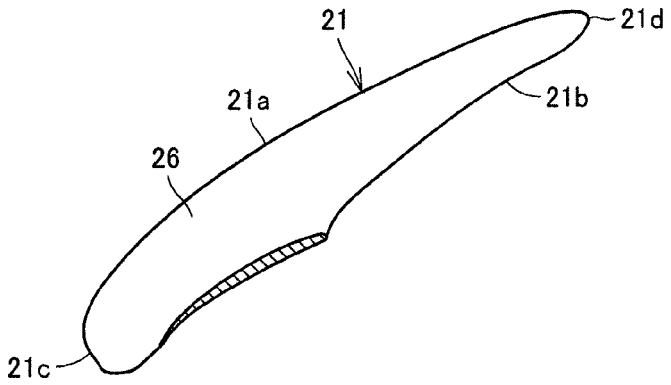
FIG. 7 is a perspective view showing a sectional shape of the propeller fan in FIG. 5 taken at a position indicated by a two-dot chain line Y.
Figure 8:
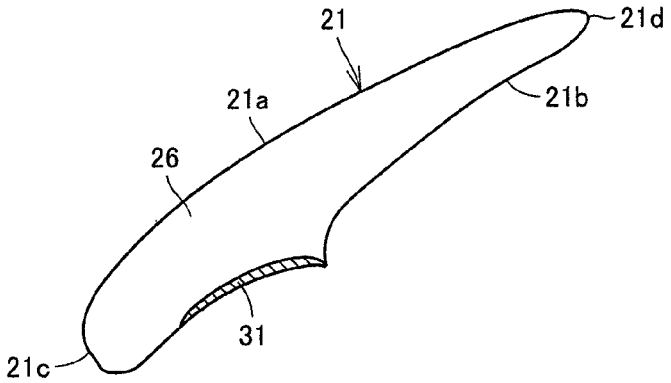
FIG. 8 is a perspective view showing a sectional shape of the propeller fan in FIG. 5 taken at a position indicated by a two-dot chain line Z.

FIG. 5 is a plan view showing an example of the propeller fan in FIG. 1. FIG. 6 is a perspective view showing a sectional shape of the propeller fan in FIG. 5 taken at a position indicated by a two-dot chain line X. FIG. 7 is a perspective view showing a sectional shape of the propeller fan in FIG. 5 taken at a position indicated by a two-dot chain line Y. FIG. 8 is a perspective view showing a sectional shape of the propeller fan in FIG. 5 taken at a position indicated by a two-dot chain line Z. FIGS. 6 and 7 each show a section of blade 21, and FIG. 8 shows a section of connection portion 31.

Referring to FIGS. 6 and 7, blade 21 is formed in a blade-like shape in which the sectional shape in the circumferential direction connecting front edge portion 21*b* and rear edge portion 21*c* has a thickness that decreases as the position moves from the vicinity of the center of the blade toward each of front edge portion 21*b* and rear edge portion 21*c*, and has the largest thickness at a position shifted from the center of the blade toward front edge portion 21*b*. Referring to FIG. 8, connection portion 31 is formed in a blade-like shape similar to that of blade 21 described above. Specifically, propeller fan 10 according to the present embodiment is formed to have a blade-like sectional shape at any sectional position between peripheral edge portion 21*a* of blade 21 and center axis 101.

The description has been given on propeller fan 10 that is integrally molded from synthetic resin, but the material for the propeller fan according to the present invention is not limited to resin. For example, propeller fan 10 may be formed by effecting twist working on a single metal plate, or may be formed of an integral thin member having a curved surface. In these cases, boss hub portion 41 that is independently molded may be joined to the rotation center of propeller fan 10.

Referring to FIG. 2, in each of blades 21A and 21B, peripheral edge portion 21*a* and rear edge portion 21*c* continue to each other at an intersection 21*e*. Intersection 21*e* is present at a position where an end of peripheral edge portion 21*a* drawing an arc having diameter D intersects with rear edge portion 21*c* which continues to the end. Intersection 21*e* in blade 21A and intersection 21*e* in blade 21B are present at the same height in the axial direction of center axis 101.

In FIG. 2, an imaginary plane 210, which includes each leading blade edge portion 21*d* connecting front edge portion 21*b* and peripheral edge portion 21*a*, and center axis 101, is defined.

Figure 9:
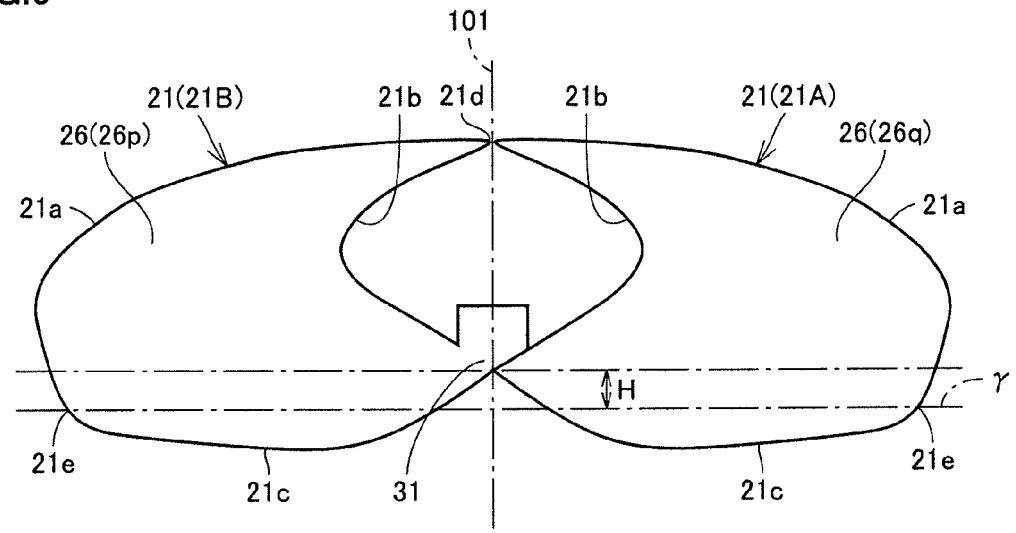
FIG. 9 is another side view showing the propeller fan in FIG. 1.

FIG. 9 is another side view showing the propeller fan in FIG. 1. FIG. 9 shows propeller fan 10 viewed in a direction indicated by an arrow IX parallel to plane 210 in FIG. 2.

Referring to FIG. 9, a plane γ, which includes intersections 21*e* in blades 21A and 21B and is perpendicular to center axis 101, is defined in the drawing. When propeller fan 10 is viewed in the direction shown in FIG. 9, front edge portion 21*b* of blade 21A and rear edge portion 21*c* of blade 21B are connected together via connection portion 31. The connected portion between front edge portion 21*b* of blade 21A and rear edge portion 21*c* of blade 21B is formed to extend from the intake side to the outlet side in the air flow feeding direction while intersecting with center axis 101 as the position moves from front edge portion 21*b* of blade 21A toward rear edge portion 21*c* of blade 21B.

When it is assumed that peripheral edge portions 21*a* of blades 21 have diameter D, and there is a distance H between plane γ and the connected portion between front edge portion 21*b* of blade 21A and rear edge portion 21*c* of blade 21B, on a line of center axis 101, propeller fan 10 according to the present embodiment satisfies $0.028 \leq H/D \leq 0.056$.

Referring to FIG. 2, in propeller fan 10 according to the present embodiment, when it is assumed that imaginary circle 102 defining connection portion 31 therein has a diameter d, diameter d of imaginary circle 102 is set to a value which is not less than 0.14 times diameter D of peripheral edge portions 21*a* of blades 21. Specifically, propeller fan 10 according to the present embodiment is formed to satisfy $0.14 \leq d/D$.

It is to be noted that, in the present invention, the relational expression between diameter d of imaginary circle 102 and diameter D of blades 21 is not a mandatory feature. Further, the propeller fan may be configured such that it satisfies $0.14 \leq d/D$ but does not satisfy $0.028 \leq H/D \leq 0.056$.

[Description of Functions and Effects Provided by Propeller Fan]

A description will now be given on functions and effects provided by propeller fan 10 according to the present embodiment.

Firstly, propeller fan 10 according to the present embodiment is provided with blade-like connection portion 31 connecting between blades 21A and 21B. With such a structure, even the rotation center portion that could not be sufficiently utilized because it is used as the boss hub portion in the conventional structure can be effectively utilized as a blade having a blade-like sectional shape and a large attack angle. This can significantly enhance air blowing capacity near the center portion where the peripheral speed is lower than that on the radially outer side, and can significantly improve air blowing performance of the whole fan.

By increasing the area of the blade performing air blowing, it is possible to increase the air flow rate at the same rotation speed. Further, a major portion of the large boss hub portion that is present at the rotation center portion in the conventional structure is replaced with connection portion 31 having a blade-like sectional shape, so that the mass of the propeller fan can be reduced. This can reduce the load on the drive motor, and can also reduce power consumption at the same air flow rate.

FIGS. 10 to 13 are views for illustrating a mechanism of the propeller fan in FIG. 1.

Figure 10:
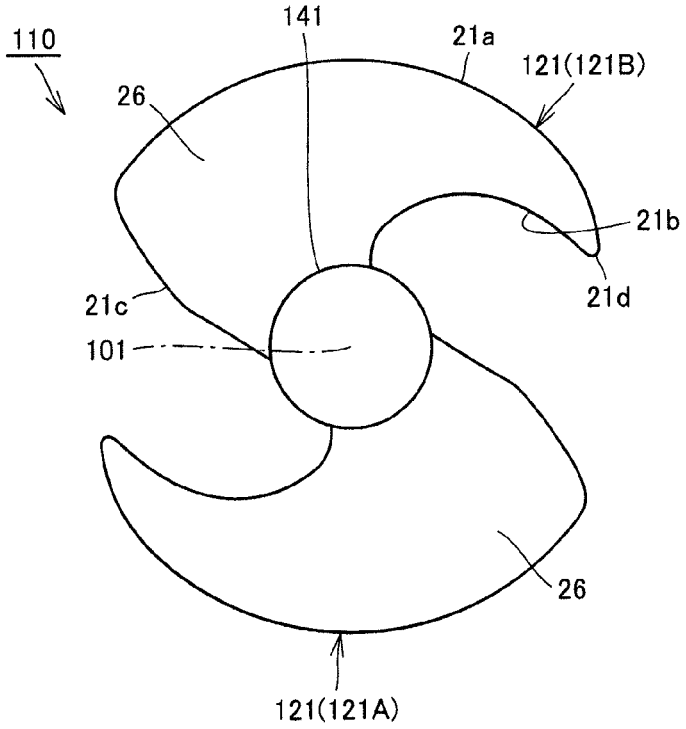
FIG. 10 is a view for illustrating a mechanism of the propeller fan in FIG. 1.
Figure 11:
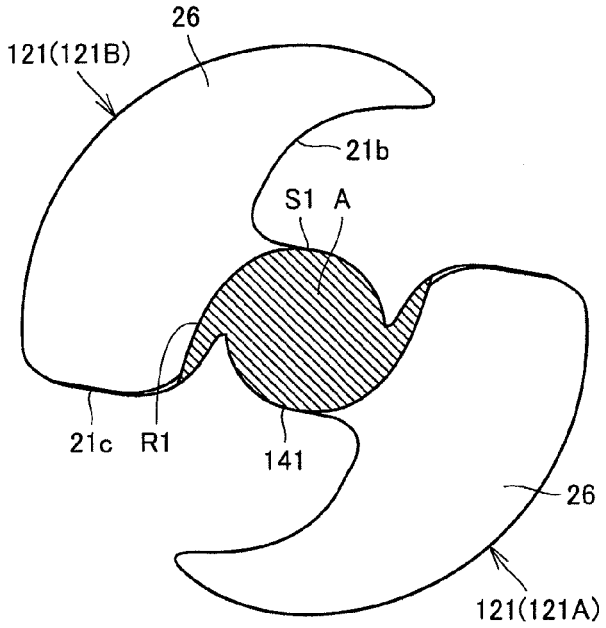
FIG. 11 is another view for illustrating the mechanism of the propeller fan in FIG. 1.

FIG. 10 shows a propeller fan for comparison. Referring to FIG. 10, a propeller fan 110 for comparison is provided at its rotation center with a boss hub portion 141, and is also provided with blades 121 (121A and 121B) extending radially outward from boss hub portion 141. The shape of blade 121 is substantially the same as that of blade 21 in FIG. 2.

Referring to FIGS. 10 to 13, the mechanism of propeller fan 10 according to the present embodiment will be described below in detail. When blades 21 of the fan are driven to rotate, wind passes over blade surfaces 26 of the fan. On this occasion, the wind firstly meets front edge portion 21*b* of blade 21, then flows along blade surface 26, and flows out from rear edge portion 21*c* of blade 21.

A phenomenon occurring in the vicinity of a position closest to the center while blades 21 are operating will now be discussed. In the case of propeller fan 110 for comparison (see FIG. 11), wind flows onto blade surface 26 through front edge portion 21*b* at a position where the base portion of blade 21 is in contact with boss hub portion 141 (S1 in FIG. 11). Thereafter, the wind rotates and is affected by the centrifugal force, so that a flow line expands slightly outward as indicated by R1 in FIG. 11 beyond a concentric circle. A hatched portion (area A) inside R1 cannot perform the work of an air blower blowing wind.

In contrast, in propeller fan 10 according to the present embodiment, boss hub portion 41 is extremely small, and even a portion at a position closer to the center operates as the blade, when compared with propeller fan 110 for comparison. Therefore, wind flows onto blade surface 36 through front edge portion 21*b* near a boundary between the base portion of blade 21 and connection portion 31 (S2 in FIG. 12). Thereafter, a flow line expands slightly outward as indicated by R2 in FIG. 12 beyond a concentric circle. Similarly to propeller fan 110 for comparison, a hatched portion (area B) inside R2 cannot perform the work of an air blower blowing wind. FIG. 13 shows an area difference (A−B) between the regions which cannot perform the work of an air blower blowing wind.

It is well known in aerodynamics that lift is proportional to area. Propeller fan 10 according to the present embodiment can generate lift increased by the above area difference (A−B). It is known that wind is blown by a reaction force caused by the reaction of lift, and when the lift is increased, the reaction force is also increased, and air blowing capacity is enhanced.

For the reasons described above, in propeller fan 10 according to the present embodiment, air blowing capacity can be improved by connection portion 31 arranged at the rotation center.

Propeller fan 10 according to the present embodiment satisfies 0.028≤H/D≤0.056, where D is the diameter of peripheral edge portions 21*a* of blades 21, and H is the distance between plane γ and the connected portion between front edge portion 21*b* of blade 21A and rear edge portion 21*c* of blade 21B, on the line of center axis 101. Next, functions and effects provided by this feature will be described.

Figure 14:
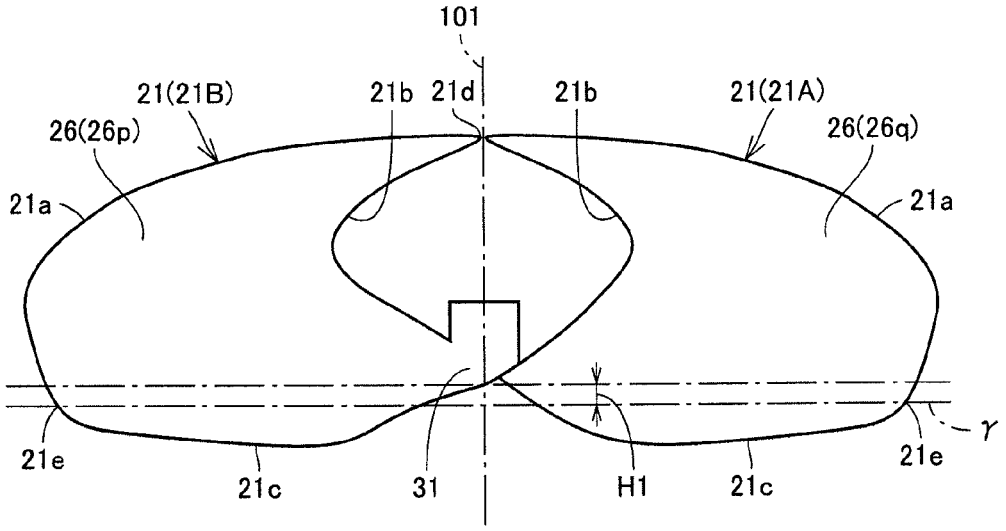
FIG. 14 is a side view showing a propeller fan as a first comparative example for the propeller fan in FIG. 9.
Figure 15:
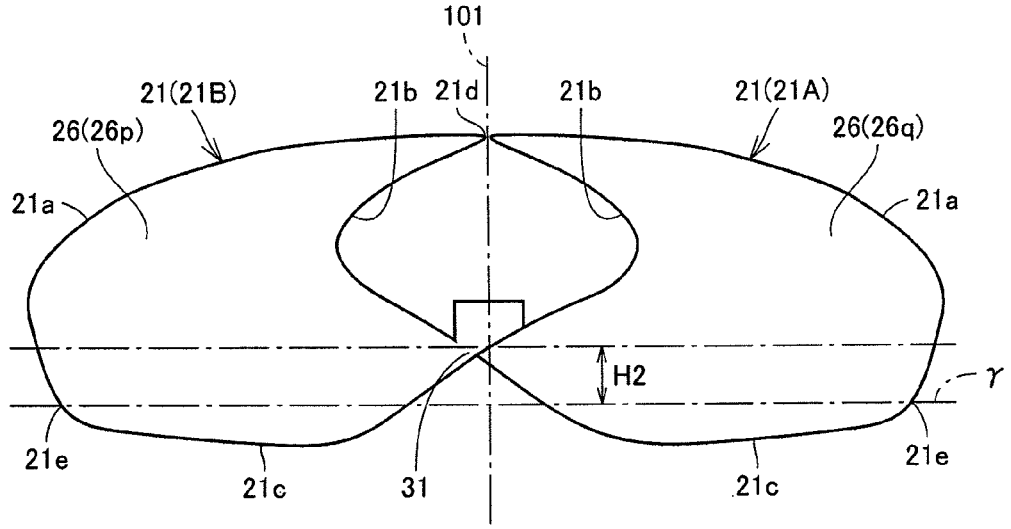
FIG. 15 is a side view showing a propeller fan as a second comparative example for the propeller fan in FIG. 9.

FIG. 14 is a side view showing a propeller fan as a first comparative example for the propeller fan in FIG. 9. FIG. 15 is a side view showing a propeller fan as a second comparative example for the propeller fan in FIG. 9.

FIG. 14 shows the propeller fan which has a distance H1 between plane γ and the connected portion between front edge portion 21*b* of blade 21A and rear edge portion 21*c* of blade 21B and which satisfies H1/D<0.028. FIG. 15 shows the propeller fan which has a distance H2 between plane γ and the connected portion between front edge portion 21*b* of blade 21A and rear edge portion 21*c* of blade 21B and which satisfies H2/D>0.056.

Referring to FIG. 14, in the case of the propeller fan according to the first comparative example in which the value of H1/D is in a range less than 0.028, the connected portion between front edge portion 21*b* of blade 21A and rear edge portion 21*c* of blade 21B extends with being inclined at a small angle with respect to a plane perpendicular to center axis 101. In this case, it is not possible to strongly blow air flowing in from front edge portion 21*b* of blade 21A and flowing out from rear edge portion 21*c* of blade 21B, near the rotation center, in the axis direction of center axis 101, and air blowing effect is impaired.

Figure 16:
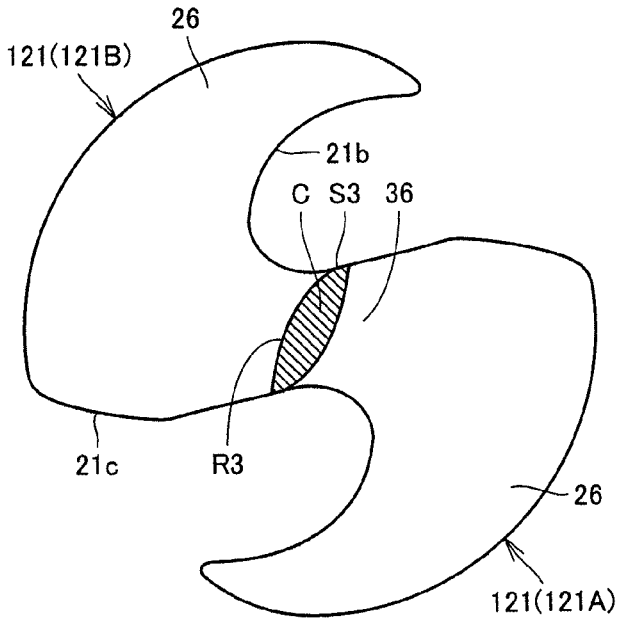
FIG. 16 is a view for illustrating a mechanism of the propeller fan in FIG. 9.
Figure 17:
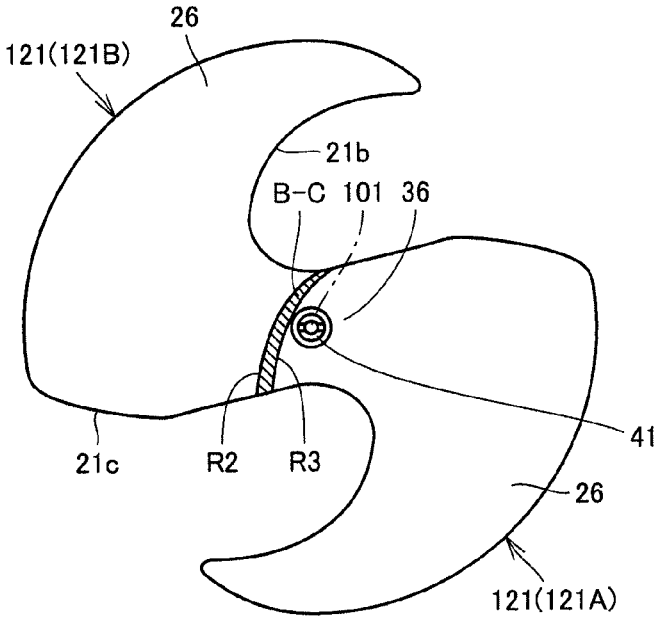
FIG. 17 is another view for illustrating the mechanism of the propeller fan in FIG. 9.

FIGS. 16 and 17 are views for illustrating a mechanism of the propeller fan in FIG. 9.

Referring to FIGS. 9, 16, and 17, on the other hand, in propeller fan 10 according to the present embodiment satisfying 0.028≤H/D, the connected portion between front edge portion 21*b* of blade 21A and rear edge portion 21*c* of blade 21B is inclined at a larger angle with respect to the plane perpendicular to center axis 101 and more warped toward the axial direction of center axis 101, when compared with the propeller fan according to the first comparative example.

Figure 12:
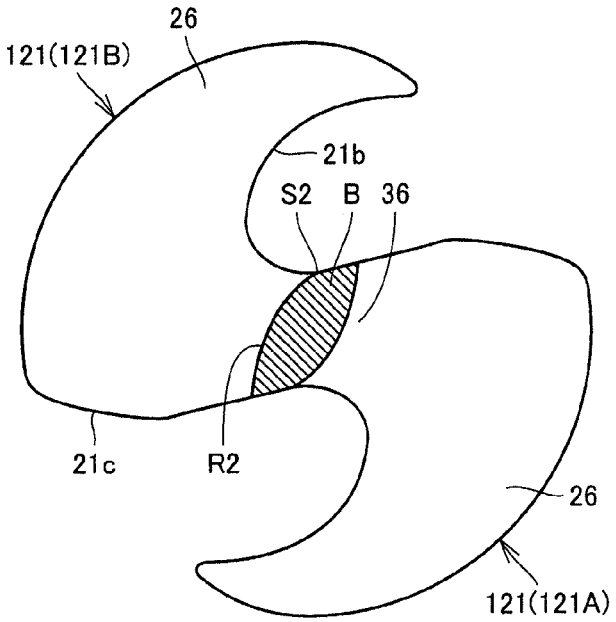
FIG. 12 is still another view for illustrating the mechanism of the propeller fan in FIG. 1.
Figure 13:
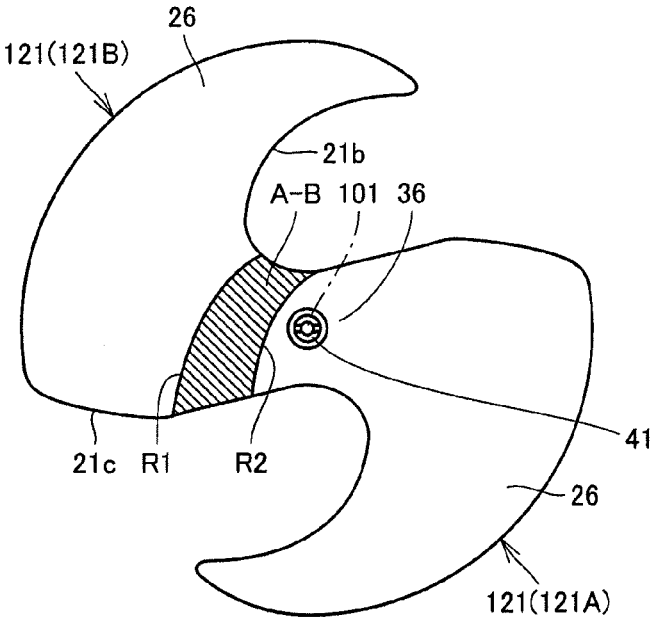
FIG. 13 is still another view for illustrating the mechanism of the propeller fan in FIG. 1.

In this case, as shown in FIG. 16, in comparison with S2 in FIG. 12, wind flows onto blade surface 26 through front edge portion 21*b* closer to the boundary between the base portion of blade 21 and connection portion 31 (S3 in FIG. 16), and thus air easily flows onto the positive pressure surface 26*q* side near the connected portion between front edge portion 21*b* of blade 21A and rear edge portion 21*c* of blade 21B. Thereafter, a flow line expands slightly outward as indicated by R3 in FIG. 16 beyond a concentric circle. A hatched portion (area C) inside R3 cannot perform the work of an air blower blowing wind. FIG. 17 shows an area difference (B−C) between the regions which cannot perform the work of an air blower blowing wind, in comparison with the propeller fan in FIG. 12.

Referring to FIG. 15, in the case of the propeller fan according to the second comparative example in which the value of H2/D is in a range more than 0.056, the connected portion between front edge portion 21*b* of blade 21A and rear edge portion 21*c* of blade 21B is inclined at a further larger angle with respect to the plane perpendicular to center axis 101. In such a structure, there is a possibility that, near the connected portion between front edge portion 21*b* of blade 21A and rear edge portion 21*c* of blade 21B, air easily flows onto the positive pressure surface 26*q* side, whereas separation of an air flow may occur on the negative pressure surface 26*p* side.

In contrast, in propeller fan 10 according to the present embodiment satisfying H/D≤0.056, blades 21 are prevented from being inclined too much at the connected portion between front edge portion 21*b* of blade 21A and rear edge portion 21*c* of blade 21B, and occurrence of separation on the negative pressure surface 26*p* side is prevented.

For the reasons described above, excellent air blowing capacity can be achieved by propeller fan 10 according to the present embodiment satisfying 0.028≤H/D≤0.056.

The effects derived from the functions and effects described above can be as follows:

(1) Since the air flow rate at the same rotation speed can be increased, noise can be reduced. (In recent years, there is a tendency, e.g., in the air conditioner, that the air flow rate is increased for improving energy-saving properties. This results in a problem that noise increases and impairs the degree of comfort in housing conditions. In contrast, propeller fan 10 according to the present embodiment can increase the air flow rate without increasing noise.)

(2) Since pressure-flow rate characteristics can be improved, fan performance can be improved. (In recent years, there is a tendency, e.g., in the air conditioner, that pressure loss increases as capacity of a heat exchanger is increased for improving energy-saving properties. Since the air flow rate lowers as the pressure loss of the heat exchanger increases (i.e., the trade-off relationship), there is a problem that the effect of increasing the capacity of the heat exchanger cannot be sufficiently achieved. In contrast, propeller fan 10 according to the present embodiment can improve pressure-flow rate characteristics, and therefore can suppress lowering of the air flow rate in the heat exchanger causing a large pressure loss. Consequently, it is possible to sufficiently achieve the effect of increasing the capacity of the heat exchanger.)

(3) Fan efficiency can be improved and power consumption can be reduced. (In recent years, there is a tendency, e.g., in the air conditioner, that the air flow rate is increased for improving energy-saving properties. This results in a problem that power consumption of a motor increases. In contrast, propeller fan 10 according to the present embodiment can suppress an increase in power consumption of a motor even when the air flow rate is increased. When the air flow rate is not increased, power consumption of the motor can be reduced owing to improved efficiency.)

(4) Reduction in weight can reduce a material, and can further reduce power consumption of the motor. (When the fan has a large weight, bearing loss of a motor shaft and the like increase, and additional power consumption is required. In contrast, propeller fan 10 according to the present embodiment can significantly reduce the weight of the fan, and thereby bearing loss of a motor shaft and the like can be reduced so that power consumption of the motor can be reduced.)

As a result, propeller fan 10 according to the first embodiment of the present invention can implement a propeller fan that greatly contributes to global environment conservation in terms of energy-saving properties and resource-saving design.

Further, in propeller fan 10 according to the present embodiment, diameter d of imaginary circle 102 is set to a value which is not less than 0.14 times diameter D of peripheral edge portions 21*a* of blades 21. This prevents connection portion 31 serving to connect the base portion of blade 21A and the base portion of blade 21B from having a size which is too small relative to an outer peripheral dimension of the blades. Consequently, strength of propeller fan 10 can be sufficiently ensured.

[Description of Structure of Propeller Fan with Three Blades]

Next, a structure of a propeller fan with three blades to which the structure of propeller fan 10 in FIG. 1 is applied will be described. For the structure identical to that of propeller fan 10 in FIG. 1, the description thereof will not be repeated.

Figure 18:
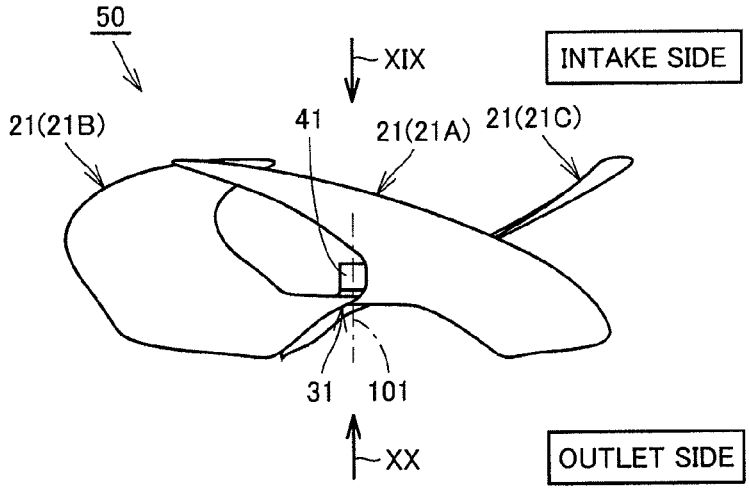
FIG. 18 is a side view showing a propeller fan with three blades according to the first embodiment of the present invention.
Figure 19:
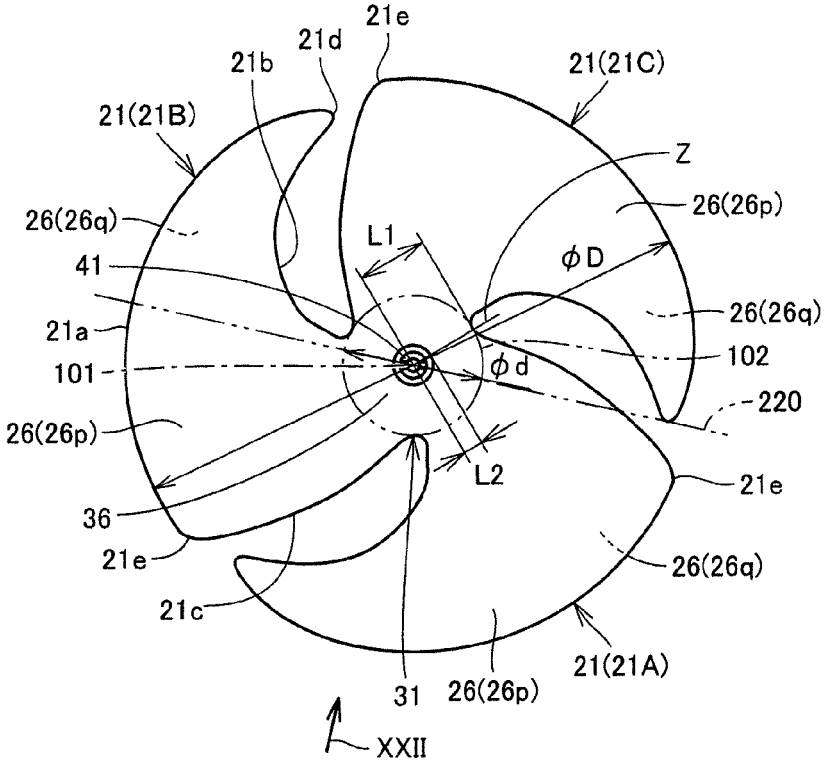
FIG. 19 is a plan view showing the propeller fan viewed in a direction indicated by an arrow XIX in FIG. 18 (i.e., from an intake side).
Figure 20:
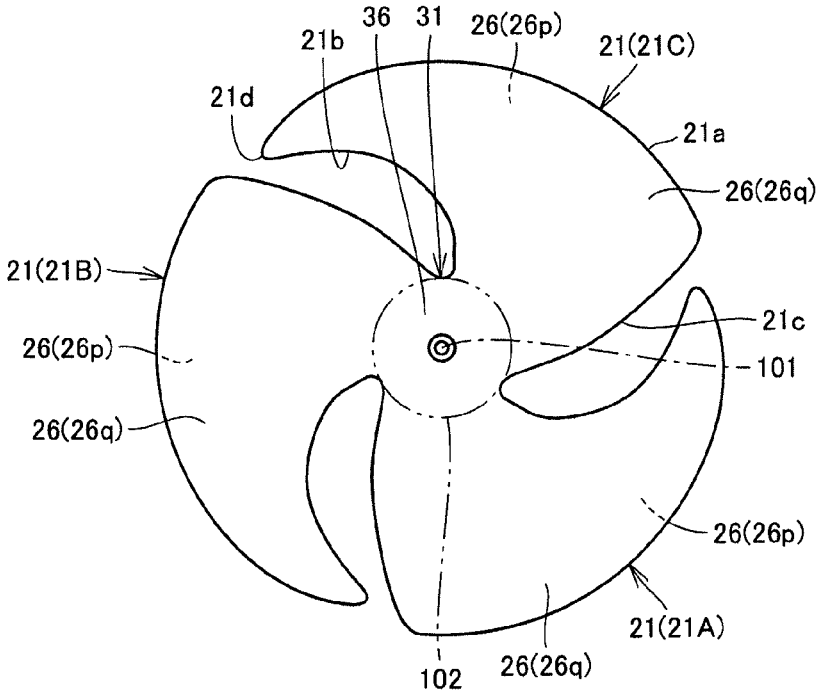
FIG. 20 is a plan view showing the propeller fan viewed in a direction indicated by an arrow XX in FIG. 18 (i.e., from an outlet side).
Figure 21:
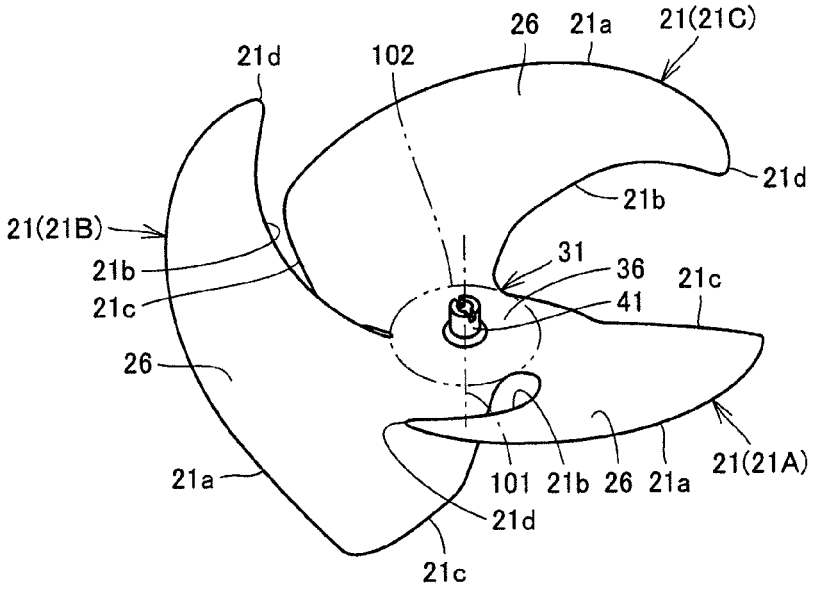
FIG. 21 is a perspective view of the propeller fan in FIG. 18 viewed from the intake side.

FIG. 18 is a side view showing a propeller fan with three blades according to the first embodiment of the present invention. FIG. 19 is a plan view showing the propeller fan viewed in a direction indicated by an arrow XIX in FIG. 18 (i.e., from an intake side). FIG. 20 is a plan view showing the propeller fan viewed in a direction indicated by an arrow XX in FIG. 18 (i.e., from an outlet side). FIG. 21 is a perspective view of the propeller fan in FIG. 18 viewed from the intake side.

Referring to FIGS. 18 to 21, a propeller fan 50 according to the present embodiment is a propeller fan with three blades. Propeller fan 50 has blades 21A, 21B, and 21C (which may be collectively referred to as "blades 21" hereinafter) that are circumferentially spaced from each other for performing air blowing according to rotation around center axis 101, and connection portion 31 connecting blades 21A, 21B, and 21C with each other.

As shown in FIG. 19, when propeller fan 50 is viewed in the axial direction of center axis 101 and the smallest imaginary circle 102 is drawn to separate blades 21A, 21B, and 21C from each other in the circumferential direction of center axis 101, connection portion 31 is defined inside imaginary circle 102, and blades 21A, 21B, and 21C are defined outside imaginary circle 102.

Blades 21A, 21B, and 21C are equally spaced from each other in the circumferential direction of a rotation axis of propeller fan 50, i.e., center axis 101. Blades 21A, 21B, and 21C are formed to have an identical shape. Blade 21B is arranged to be adjacent to blade 21A on a forward side in a rotational direction of propeller fan 50, and blade 21C is arranged to be adjacent to blade 21B on the forward side in the rotational direction of propeller fan 50.

Base portions of blades 21A, 21B, and 21C arranged on the outer periphery of imaginary circle 102 are coupled together by connection portion 31 arranged around center axis 101. In propeller fan 50 according to the present embodiment, one-piece three blades extending radially outward from center axis 101 as its center are integrally molded with blades 21A, 21B, and 21C as well as connection portion 31.

As most clearly shown in FIG. 21, front edge portion 21*b* of blade 21A and rear edge portion 21*c* of blade 21B are connected together via connection portion 31, front edge portion 21*b* of blade 21B and rear edge portion 21*c* of blade 21C are connected together via connection portion 31, and front edge portion 21*b* of blade 21C and rear edge portion 21*c* of blade 21A are connected together via connection portion 31. Imaginary circle 102 is drawn to be in contact with a connected portion between front edge portion 21*b* of blade 21A and rear edge portion 21*c* of blade 21B, to be in contact with a connected portion between front edge portion 21*b* of blade 21B and rear edge portion 21*c* of blade 21C, and to be in contact with a connected portion between front edge portion 21*b* of blade 21C and rear edge portion 21*c* of blade 21A.

Propeller fan 50 has boss hub portion 41 as a center axis portion. Connection portion 31 is formed to extend radially outward from the outer peripheral surface of boss hub portion 41. In other words, connection portion 31 is formed such that, when propeller fan 50 is viewed in the axial direction of center axis 101, the minimum length L1 of connection portion 31 from center axis 101 on imaginary line Z passing through center axis 101 is larger than length L2 of boss hub portion 41 from center axis 101 on imaginary line Z (see FIG. 19).

Referring to FIG. 19, in propeller fan 50 with three blades according to the present embodiment, in each of blade 21A, 21B, and 21C, peripheral edge portion 21*a* and rear edge portion 21*c* continue to each other at intersection 21*e*. Intersection 21*e* in blade 21A, intersection 21*e* in blade 21B, and intersection 21*e* in blade 21C are present at the same height in the axial direction of center axis 101.

In the drawing, an imaginary plane 220, which includes leading blade edge portion 21*d* connecting front edge portion 21*b* and peripheral edge portion 21*a* in blade 21C, and center axis 101, is defined.

Figure 22:
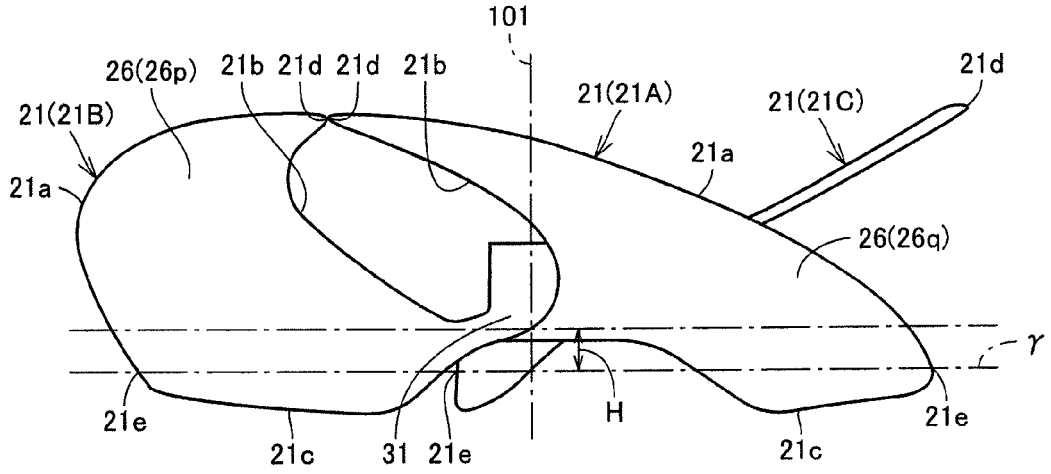
FIG. 22 is another side view showing the propeller fan in FIG. 18.

FIG. 22 is another side view showing the propeller fan in FIG. 18. FIG. 22 shows propeller fan 50 viewed in a direction indicated by an arrow XXII perpendicular to plane 220 in FIG. 19.

Referring to FIG. 22, plane γ, which includes intersections 21*e* in blades 21A, 21B, and 21C and is perpendicular to center axis 101, is defined. When propeller fan 50 is viewed in the direction shown in FIG. 22, front edge portion 21*b* of blade 21A and rear edge portion 21*c* of blade 21B are connected together via connection portion 31.

When it is assumed that peripheral edge portions 21*a* of blades 21 have diameter D, and there is distance H between plane γ and the connected portion between front edge portion 21*b* of blade 21A and rear edge portion 21*c* of blade 21B, on the line of center axis 101, propeller fan 50 according to the present embodiment satisfies $0.028 \leq H/D \leq 0.056$.

Also in propeller fan 50 with three blades configured as described above, functions and effects identical to those of propeller fan 10 with two blades described above are provided.

[Description of Examples for Confirming Functions and Effects]

Next, a description will be given on examples performed for confirming the functions and effects provided by propeller fans 10 and 50 according to the present embodiment.

Figure 23:
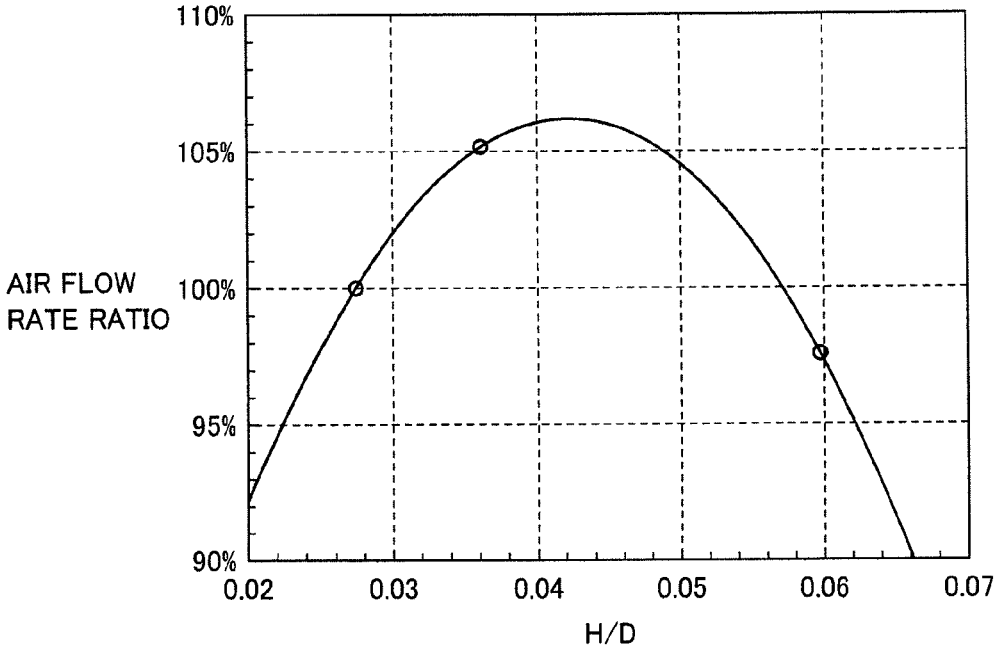
FIG. 23 is a graph showing relationship between H/D and an air flow rate of the propeller fan in FIG. 1.

FIG. 23 is a graph showing relationship between H/D and the air flow rate of the propeller fan in FIG. 1.

Referring to FIG. 23, in the present example, plural types of propeller fans having different values of H (distance between plane γ and the connected portion between front edge portion 21*b* of blade 21A and rear edge portion 21*c* of blade 21B)/D (diameter D of peripheral edge portions 21*a* of blades 21) were prepared, and rotated at a constant rotation speed. Air flow rates in the propeller fans were measured, and measurement results were plotted into the graph in FIG. 23. In the present example, diameter D was set to 460 mm, and the rotation speed was set to 1000 rpm.

In FIG. 23, the axis of ordinates represents the magnitude of the air flow rate measured at each H/D, using the value of the air flow rate measured at H/D=0.028 as a reference (100%).

As shown in FIG. 23, the air flow rate increased as the value of H/D increased, became maximum when the value of H/D was about 0.042, and then decreased as the value of H/D further increased. As a result, it was able to confirm that a high air flow rate is obtained in the range of $0.028 \leq H/D \leq 0.056$ centered at H/D=0.042.

Figure 24:
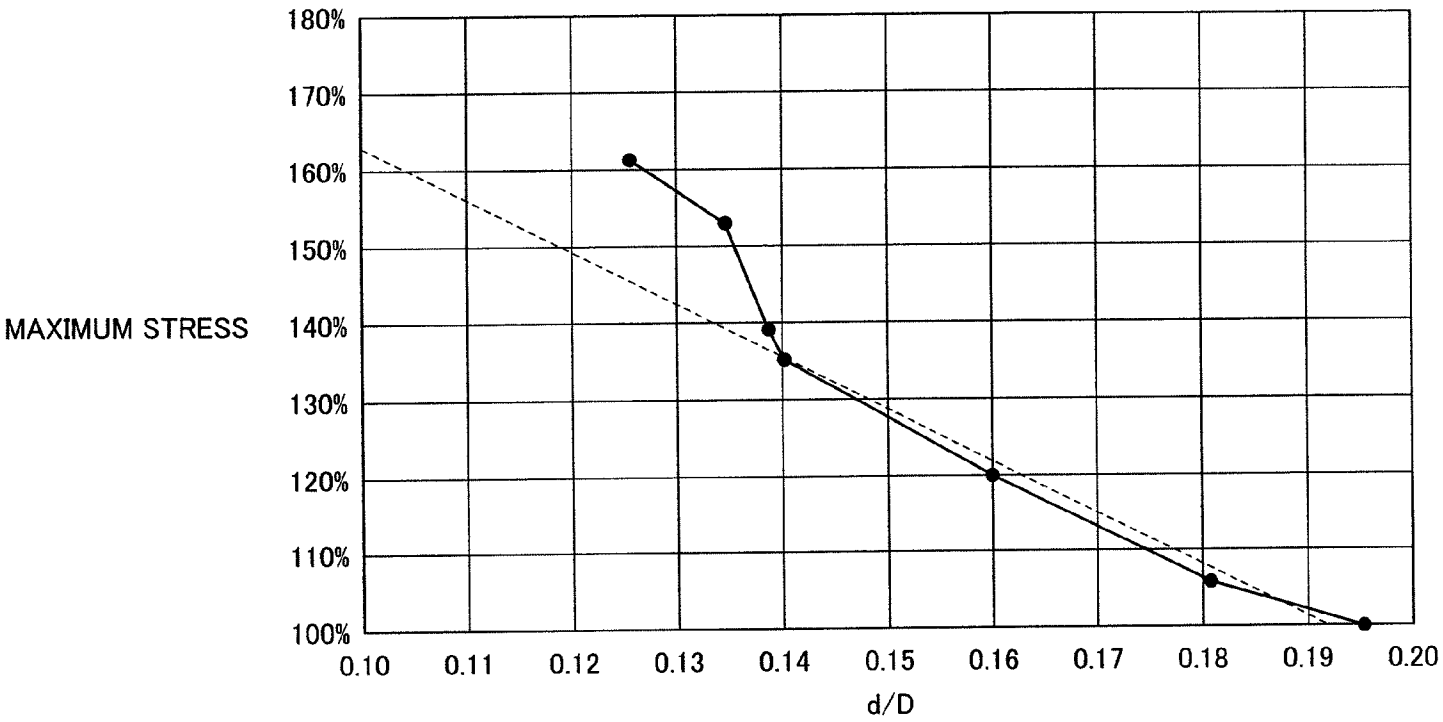
FIG. 24 is a graph showing relationship between d/D and the maximum stress of the propeller fan in FIG. 1.

FIG. 24 is a graph showing relationship between d/D and the maximum stress of the propeller fan in FIG. 1.

Referring to FIG. 24, in the present example, how the maximum stress of the propeller fan would change according to changes in d (diameter of imaginary circle 102)/D (diameter D of peripheral edge portions 21*a* of blades 21) was measured by simulation, and results thereof were plotted into the graph shown in FIG. 24. In the simulation, the propeller fan was rotated around center axis 101 to determine a stress acting on the entire propeller fan due to a centrifugal load. The rotation speed was set to be constant at 1000 rpm, and the stress which was the greatest of stress values acting on the entire propeller fan was determined as the maximum stress.

In FIG. 24, the axis of ordinates represents the magnitude of the maximum stress measured at each d/D, using the value of the maximum stress measured at d/D=0.195 as a reference (100%).

As a result of the measurement, the maximum stress of propeller fan 10 gradually increased as the value of d/D decreased, that is, as the ratio of the size of connection portion 31 to the outer periphery of the blades decreased. On this occasion, when the value of d/D was in a range less than 0.14, the maximum stress significantly increased, and the strength of propeller fan 10 significantly decreased. As a result, it was able to confirm that the strength of propeller fan 10 can be ensured in the range of $0.14 \leq d/D$.

Although the air flow ratio and the maximum stress were measured for propeller fan 10 with two blades as an example in the above examples, measurement results similar to those shown in FIGS. 23 and 24 are also obtained for propeller fan 50 with three blades.

Second Embodiment

In the present embodiment, firstly, a structure of a molding die for molding the propeller fans according to the first embodiment from resin will be described.

Figure 25:
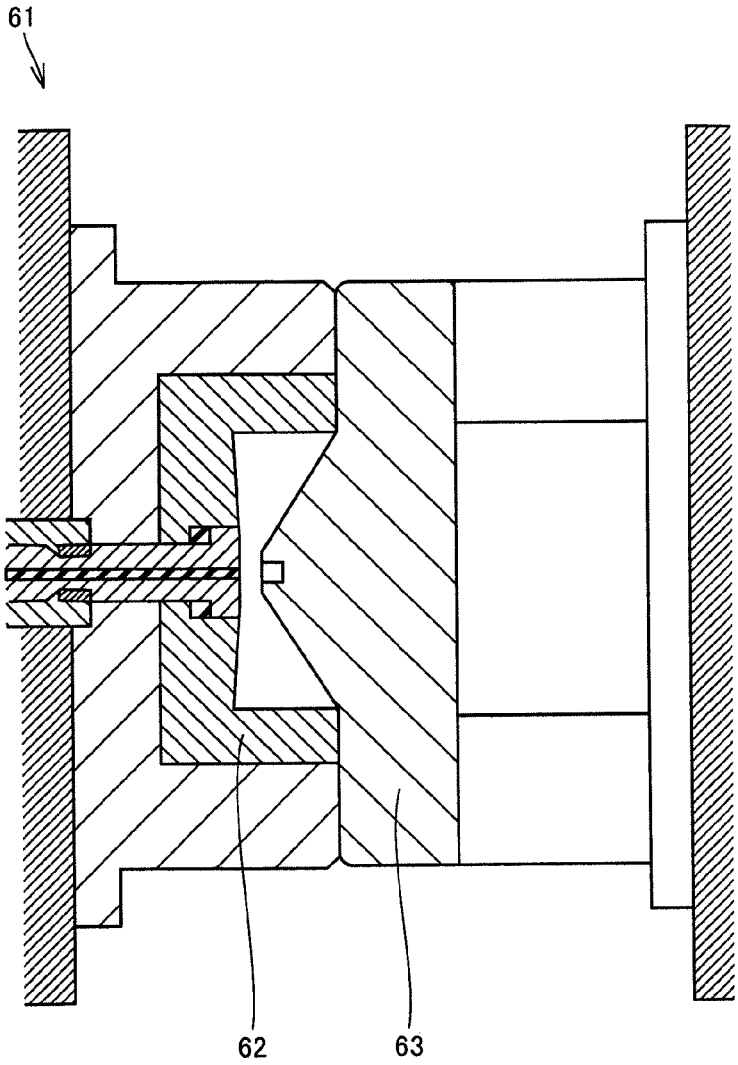
FIG. 25 is a cross sectional view showing a molding die used for manufacturing a propeller fan.

FIG. 25 is a cross sectional view showing a molding die used for manufacturing a propeller fan. Referring to FIG. 25, a molding die 61 has a stationary die 62 and a movable die 63. Stationary die 62 and movable die 63 define a cavity which has substantially the same shape as that of the propeller fan and into which flowable resin is to be injected.

Molding die 61 may be provided with a heater (not shown) for increasing flowability of the resin injected into the cavity. Such provision of the heater is particularly effective when synthetic resin having an increased strength such as glass-fiber-filled AS resin is used.

Molding die 61 shown in FIG. 25 is employed on the assumption that stationary die 62 forms a surface of the propeller fan on the positive pressure surface side, and movable die 63 forms a surface of the propeller fan on the negative pressure surface side. However, stationary die 62 may form the surface of the propeller fan on the negative pressure surface side, and movable die 63 may form the surface of the propeller fan on the positive pressure surface side.

Some propeller fans are made of metal and integrally formed through drawing by press working. Since it is difficult to perform such drawing on a thick metal plate and using a thick metal plate also leads to an increase in a mass, a thin metal plate is generally used. In this case, it is difficult for a large propeller fan to maintain strength (rigidity). In response, some propeller fans employ a part called "spider" that is formed of a metal plate thicker than the blade portion for fixing the blade portion to the rotation axis. However, this results in a problem that the mass is large and fan balance is impaired. Further, since a metal plate which is thin and has a constant thickness is generally used, this results in a problem that the blade portion cannot have a blade-like sectional shape.

In response, these problems can be collectively solved by forming a propeller fan using resin.

Next, a description will be given on an outdoor unit of an air conditioner as an example of a fluid feeder having propeller fan 10 according to the first embodiment.

Figure 26:
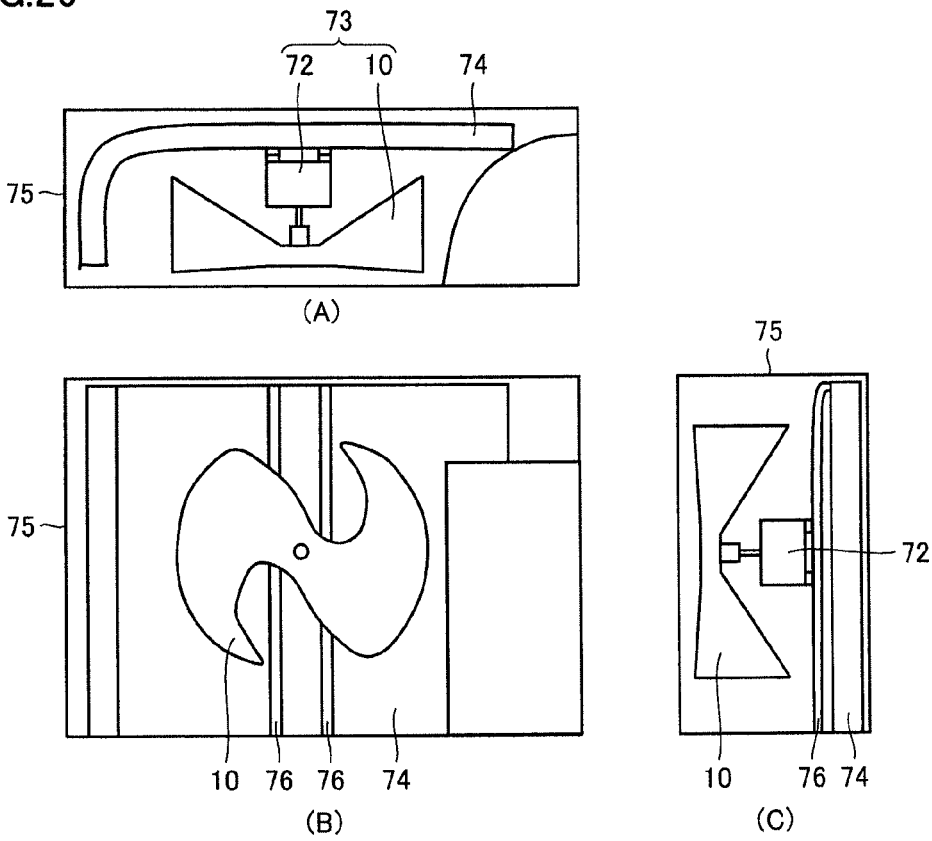
FIG. 26 is a view showing an outdoor unit of an air conditioner using a propeller fan.

FIG. 26 is a view showing an outdoor unit of an air conditioner using a propeller fan. Referring to FIG. 26, an outdoor unit 75 of the air conditioner includes an air blower 73 having propeller fan 10 according to the first embodiment and a drive motor 72. Air blower 73 feeds a fluid. In addition, an outdoor heat exchanger 74 is provided inside outdoor unit 75, and heat exchange is efficiently performed by air blower 73. Air blower 73 is installed in outdoor unit 75 using motor angles 76.

With such a structure, outdoor unit 75 has propeller fan 10 described in the first embodiment, and therefore can suppress generation of noise to attain low operation noise.

Further, since propeller fan 10 improves air blowing efficiency, energy consumption can also be reduced in outdoor unit 75. The same effects can also be achieved when propeller fan 50 described the first embodiment is used.

In the present embodiment, the outdoor unit of the air conditioner has been described as an example of the fluid feeder. However, the same effects can also be achieved in devices for feeding a fluid such as an air purifier, a humidifier, an electric fan, a fan heater, a cooling device, and a ventilating device, by applying the propeller fan thereto.

It should be understood that the embodiments disclosed herein are illustrative and non-restrictive in every respect. The scope of the present invention is defined by the scope of the claims, rather than the description above, and is intended to include any modifications within the scope and meaning equivalent to the scope of the claims.

INDUSTRIAL APPLICABILITY

The present invention is primarily applied to a home electric appliance having an air blowing function such as an air purifier and an air conditioner.

REFERENCE SIGNS LIST

10, 50: propeller fan, 21, 21A, 21B, 21C: blade, 21*a*: peripheral edge portion, 21*b*: front edge portion, 21*c*: rear edge portion, 21*d*: leading blade edge portion, 21*e*: intersection, 26: blade surface, 26*q*: positive pressure surface, 26*p*: negative pressure surface, 31: connection portion, 36: blade surface, 41: boss hub portion, 61: molding die, 62: stationary die, 63: movable die, 72: drive motor, 73: air blower, 74: outdoor heat exchanger, 75: outdoor unit, 76: motor angle, 101: center axis, 102: imaginary circle, 210, 220: plane.

The invention claimed is:

1. A propeller fan with two blades, comprising:

a first blade and a second blade which are provided to be circumferentially separated from each other for performing air blowing according to rotation around an imaginary center axis, and which constitute the two blades; and a connection portion provided, when the propeller fan is viewed in an axial direction of said center axis and a smallest imaginary circle is drawn to circumferentially separate said first blade and said second blade from each other, to be arranged inside the imaginary circle for connecting said first blade and said second blade together, wherein each of said first blade and said second blade has a peripheral edge portion extending in an arc having a diameter D with said center axis as a center thereof, a front edge portion arranged on a forward side in a rotational direction, a rear edge portion arranged on an opposite side in the rotational direction and continuing to said peripheral edge portion, and a leading blade edge portion connecting said front edge portion and said peripheral edge portion and protruding toward the rotational direction, said front edge portion of said first blade and said rear edge portion of said second blade are connected together via said connection portion, a plane which includes each intersection between said rear edge portion and said peripheral edge portion in each of said first blade and said second blade and is perpendicular to said center axis is defined as γ, and when the propeller fan is viewed in a direction parallel to a plane including said leading blade edge portions of said first blade and said second blade and said center axis, a distance H between said plane γ and a connected portion between said front edge portion of said first blade and said rear edge portion of said second blade, on a line of said center axis, satisfies $0.028 \leq H/D \leq 0.056$.

2. The propeller fan according to claim 1, wherein said connection portion has a blade surface-like surface for performing air blowing according to rotation in a region which extends between said first blade and said second blade and connects a base portion of said first blade and a base portion of said second blade.

3. The propeller fan according to claim 1, wherein said imaginary circle has a diameter d satisfying $0.14 \leq d/D$.

4. The propeller fan according to claim 1, wherein the propeller fan is molded from resin.

5. A fluid feeder comprising the propeller fan according to claim 1.

6. A propeller fan with three blades, comprising:

a first blade, a second blade, and a third blade which are provided to be circumferentially separated from each other for performing air blowing according to rotation around an imaginary center axis, and which constitute the three blades; and a connection portion provided, when the propeller fan is viewed in an axial direction of said center axis and a smallest imaginary circle is drawn to circumferentially separate said first blade, said second blade, and said third blade from each other, to be arranged inside the imaginary circle for connecting said first blade, said second blade, and said third blade together, wherein each of said first blade, said second blade, and said third blade has a peripheral edge portion extending in an arc having a diameter D with said center axis as a center thereof, a front edge portion arranged on a forward side in a rotational direction, a rear edge portion arranged on an opposite side in the rotational direction and continuing to said peripheral edge portion, and a leading blade edge portion connecting said front edge portion and said peripheral edge portion and protruding toward the rotational direction, said second blade is arranged to be adjacent to said first blade on the forward side in the rotational direction, and said third blade is arranged to be adjacent to said second blade on the forward side in the rotational direction, said front edge portion of said first blade and said rear edge portion of said second blade are connected together via said connection portion, a plane which includes each intersection between said rear edge portion and said peripheral edge portion in each of said first blade, said second blade, and said third blade and is perpendicular to said center axis is defined as γ, and when the propeller fan is viewed in a direction perpendicular to a plane including said leading blade edge portion of said third blade and said center axis, a distance H between said plane γ and a connected portion between said front edge portion of said first blade and said rear edge portion of said second blade, on a line of said center axis, satisfies $0.028 \leq H/D \leq 0.056$.

7. The propeller fan according to claim 6, wherein said connection portion has a blade surface-like surface for performing air blowing according to rotation in a region which extends between adjacent blades among said first blade, said second blade, and said third blade and connects base portions of the adjacent blades.

8. The propeller fan according to claim 6, wherein said imaginary circle has a diameter d satisfying $0.14 \leq d/D$.

9. The propeller fan according to claim 6, wherein the propeller fan is molded from resin.

10. A fluid feeder comprising the propeller fan according to claim 6.

* * * * *